US006145452A

United States Patent [19]

Heger et al.

[11] Patent Number: 6,145,452

[45] **Date of Patent: *Nov. 14, 2000**

[54] CERAMIC LINING

[75] Inventors: Armin Heger, Nussbaumen; Stefan Reh, Brugg, both of Switzerland; Andreas Pfeiffer, Lauchringen; Axel Kranzmann, Stuttgart, both of Germany

[73] Assignee: ABB Research Ltd., Zurich, Switzerland

[ * ] Notice: This patent is subject to a terminal disclaimer.

[21] Appl. No.: 09/119,670

[22] Filed: Jul. 21, 1998

[30] Foreign Application Priority Data

Jul. 28, 1997 [EP] European Pat. Off. ..... 97 810 538

[51] Int. Cl.[7] ..... F23M 5/00; F23M 13/00; F27D 1/00

[52] U.S. Cl. ..... 110/336; 110/338; 52/506.02; 52/506.05; 411/75; 411/904

[58] Field of Search ..... 110/336, 337, 110/338, 339, 340; 202/267.1; 52/506.1, 506.05, 506.02, 506.03; 411/51, 52, 53, 54, 75, 76, 77, 78, 79, 80, 904

[56] References Cited

U.S. PATENT DOCUMENTS

| | | | |
|---|---|---|---|
| 2,367,883 | 1/1945 | Miller . | |
| 3,652,251 | 3/1972 | Brichard | 110/336 X |
| 3,838,665 | 10/1974 | Astrom . | |
| 4,432,289 | 2/1984 | Norman et al. | 110/336 |
| 4,442,647 | 4/1984 | Olsen . | |
| 5,083,424 | 1/1992 | Becker | 110/336 X |
| 5,390,468 | 2/1995 | Probst | 52/506.1 X |
| 5,540,514 | 7/1996 | Demars et al. | 52/506.05 X |
| 5,624,256 | 4/1997 | Pfeiffer et al. . | |
| 5,957,067 | 9/1999 | Dobbeling et al. | 110/336 |

FOREIGN PATENT DOCUMENTS

| | | |
|---|---|---|
| 0078208 | 5/1983 | European Pat. Off. . |
| 0724116A2 | 7/1996 | European Pat. Off. . |
| 438568 | 12/1926 | Germany . |
| 19502730A1 | 8/1996 | Germany . |

*Primary Examiner*—Ira S. Lazarus
*Assistant Examiner*—Ljiljana V. Ciric
*Attorney, Agent, or Firm*—Burns, Doane, Swecker & Mathis, L.L.P.

[57] ABSTRACT

An arrangement for insulating a wall of a metallic combustion chamber is disclosed. A layer of insulating material is applied to the metallic wall and a plurality of ceramic wall panels are applied over the ceramic insulation material. The wall panels are retained by fastening elements that pass through an opening in the wall panels. The opening in the wall panels has a frusto-conical surface and the engagement surface of the fastening element is at least partially spherical to avoid mechanical and thermal stresses.

4 Claims, 2 Drawing Sheets

CERAMIC LINING

BACKGROUND OF THE INVENTION

1. Field of the Invention

The invention relates to ceramic linings a insulating of metallic walls of combustion chambers.

2. Discussion of Background

A ceramic lining of the type mentioned at the beginning is known from DE 195 02 730 A1. The lining there has the purpose of an uncooled detachable lining of a combustion space with ceramic elements which withstand the high mechanical and thermal stresses in a commercial heavy-duty combustion chamber.

For this purpose, the lining comprises at least one wall panel, made of refractory structural ceramic and having at least one through-opening, and a fastening element per opening. The fastening element is fastened by its foot in a metallic holding device fastened on the metallic supporting wall. The head of the fastening element rests in the opening in the wall panel. Arranged between the metallic wall and the ceramic wall panel is an insulating layer. The fastening element consists of refractory structural ceramic and is resiliently coupled to the holding device. Regarded as the advantages are that the lining can withstand very high mechanical and thermal stresses on account of its homogeneity and the material used and that the lining can be disassembled without being destroyed and can therefore be used repeatedly. Furthermore, the resilient coupling of the ceramic structure to the metallic holding construction allows the thermal expansions between metallic and ceramic components or deformations of the insulating layer due to mechanical stresses to be absorbed. It is considered particularly expedient for the fastening element to have a thermically optimized form, preferably a concavity in the center of the head, a rounded-off head and rounded-off cross-sectional transitions with large radii from the head to the shank and from the shank to the foot. This achieves the effect that the mechanically and thermally induced loads cause only minor stresses.

In the case of this known lining, a surface contact was chosen between the component to be fastened and the component via which the pressing force is introduced. For this purpose, the seat of the bolt on the tile is designed as a ball/ball seat. One of the reasons for this is to ensure a pendulum motion of the bolt free from any bending moments, since said bolt can get into a skewed position as a result of production and assembly inaccuracies and/or also due to operationally caused displacements of the components.

In the ideal case, when the ball diameter of the bolt corresponds precisely to that of the tile, there is negligible Hertzian stress at the contact surface. If, however, the two ball diameters involved deviate from each other, which may be the consequence of production tolerances and/or thermal expansions, there is immediately just linear contact of the two components at one edge of the tile-ball seat. The ball seat terminates via radii at its ends. As a result, with the differences in diameter mentioned there are immediately two convex surfaces facing each other. This leads to very high undesired Hertzian stresses.

SUMMARY OF THE INVENTION

Accordingly, on the basis of the finding that a surface contact abruptly changes into an uncontrolled linear contact or even just point contact if differences occur in the geometry of the elements involved, one object of the invention is to provide for a fastening of brittle components on which the contact pressure can change its direction of application, a novel seat geometry which ensures controllable linear contact throughout all operating states.

This is achieved according to the invention by the fastening element being provided with a cross-sectionally rounded-off head, which is pressed with the rounded portion on a cross-sectionally straight bearing surface of the wall panel opening.

The advantage of the invention is to be seen in particular in the simplicity of the measure. While retaining the angular mobility of the bolt, the solution is distinguished by low-cost production.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein an exemplary embodiment of the invention is represented

DESCRIPTION OF THE PREFERRED EMBODIMENTS

Figure 1:
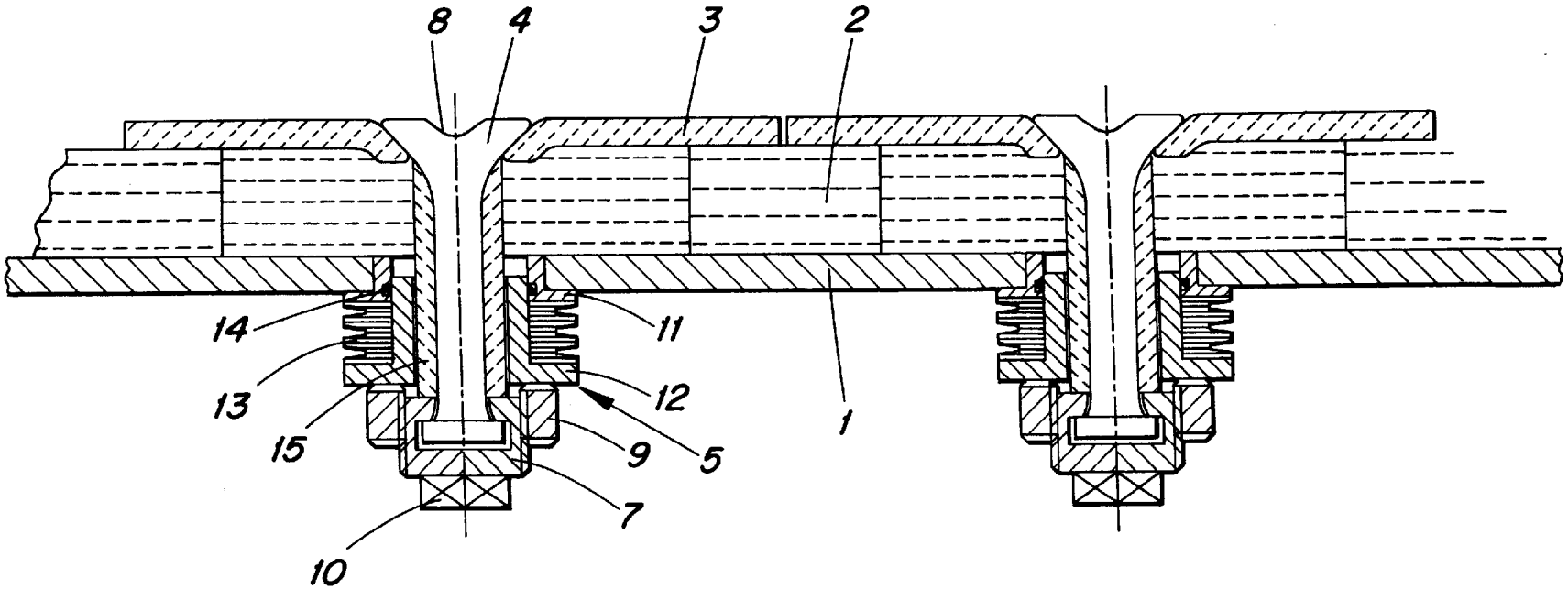
FIG. 1 shows a partial longitudinal section of the lining for a gas-turbine combustion chamber.

Referring now to the drawings, wherein like reference numerals designate identical or corresponding parts throughout the several views and only the elements essential for understanding the invention are shown FIG. 1 shows there is a partial longitudinal section of the lining according to the invention for a gas-turbine combustion chamber. Applied on top of the metallic supporting wall 1 of the combustion chamber is an insulating layer 2. This preferably consists of ceramic fibrous material. Arranged in turn on the insulating layer are ceramic wall panels 3, which consist of refractory structural ceramic, for example SiC or $Si_3N_4$. The wall panels 3 and the insulating layer 2 are fastened on the metallic supporting wall 1 with the aid of fastening elements 4, which are in each case arranged in a metallic holding device 5, which serves as a holding means for resiliently urging the head portion 20 against the wall panel bearing surface 22, and is described in detail later. Like the wall elements 3, these fastening elements 4 likewise consist of refractory structural ceramic.

The outer form and dimensions of the wall panels 3 can be adapted unproblematically to the geometry of the space to be lined and are not predetermined in any way.

Figure 2:
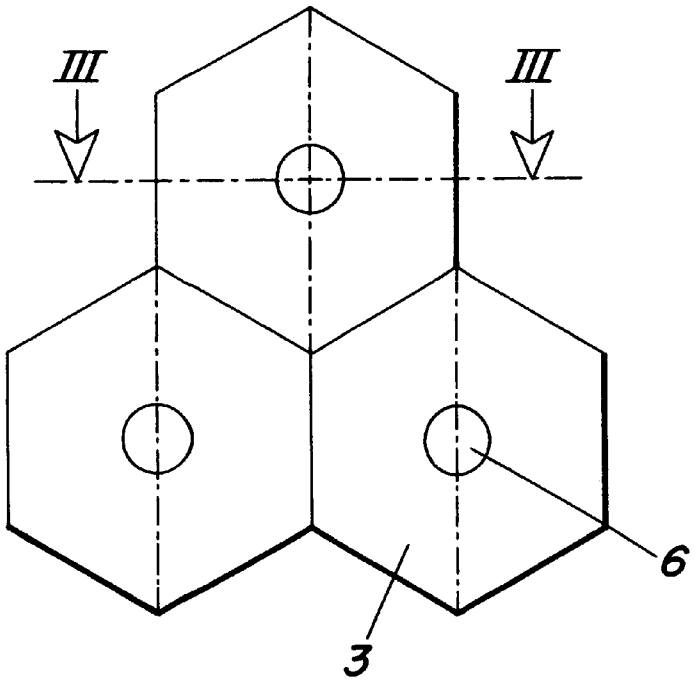
FIG. 2 shows a plan view of the lining, using hexagonal ceramic wall panels.

FIG. 2 shows a possible form of the wall panels 3. In this design variant, they have a hexagonal outer contour. For reasons of simple manufacture and uniform stress distribution under thermal and mechanical stress, symmetrical forms are to be preferred. The thickness d of the wall panel 3 is governed on the one hand by the required mechanical stability and on the other hand by a minimization of the thermal stresses on account of temperature gradients in the component. In the simplest case, a square contour may also be used, in order to line planar or only slightly curved combustion spaces. Similarly, wall panels 3 with a rectangular outer contour can also be used.

In the center of the wall panel 3 there is arranged a through-opening 6 for receiving a fastening element 4, which in this case is a bolt which comprises a head, shank and foot. It goes without saying that, in other exemplary embodiments not shown here, there may also be a plurality of openings 6 in each wall panel 3.

Figure 3:
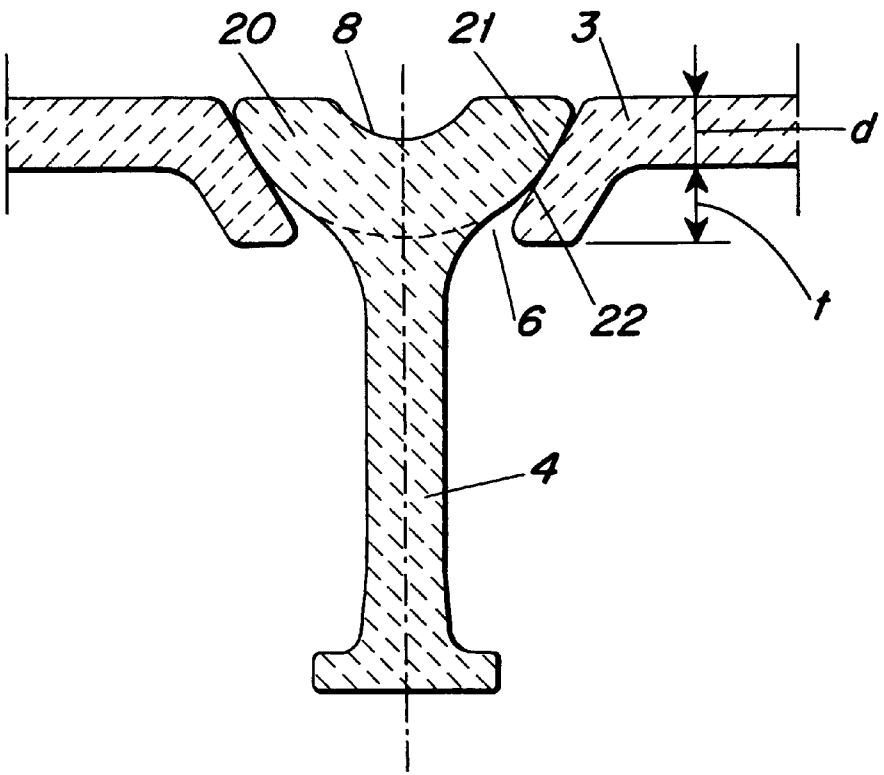
FIG. 3 shows an enlarged section of the wall panel with the fastening element in the region of the opening along the line III-III in FIG. 2.

As revealed by FIG. 3, which shows an enlarged section of the wall panel 3 according to FIG. 2 in the region of the opening 6 along the line IV—IV, the opening 6 is drawn in in the direction of the metallic supporting wall 1. As a result, on the one hand the contact surface between the fastening element 4 and the wall panel 3 is enlarged, on the other hand the heat flows in cases of stress gradients of a steady state and non-steady state are influenced in such a way that only minimal thermal stresses occur. The geometrical shaping of this zone results from a tradeoff between the heat-accumulating and heat-conducting properties of the materials used. A ratio of the thickness d of the wall panel 3 to the depth t of the drawn-in part of the wall panel 3 in the region of the opening 6 of about 5 to 3 has proven advantageous.

The contact surface between the head 20 of the fastening element 4, arranged in the opening 6, and the wall panel 3 is configured according to the invention in an optimum way, in order to ensure definite contact even in the case of slight angular positions of the bolt. For this purpose, the head 20 is provided with a spherical bearing surface, which bears with its rounded portion 21 on a cross-sectionally straight bearing surface 22. This straight portion is the wall of the wall panel 3 bounding the opening 6. With this measure, the region in which linear contact occurs can be easily determined, since the tolerances to be expected are generally known. The Hertzian stress occurring in the case of the surfaces pressed against one another - here convex surface against planar surface - is much less than in the case of the known ball/ball seats and can easily be determined analytically. Nevertheless, a good sealing effect is also achieved here, if desired in the first place.

In the case of the example, the cavity between the shank of the fastening element 4 and the insulating layer 2 is filled by a divided sleeve 15 of strengthened, preformed insulating material.

There is provided an expansion-tolerant flexible restraint of the ceramic fastening element 4 on the outside of the metallic supporting wall 1. According to FIG. 1, the metallic holding device 5 comprises a longitudinally divided threaded sleeve 7, which encloses the foot of the fastening element. Arranged on the external thread of the threaded sleeve 7 is a threaded nut 9, by means of which the restraining force can be set, as explained further below. At the same time, the nut 9 holds the two halves of the threaded sleeve 7 together. The mutual positioning of the two halves of the threaded sleeve can be secured by additional constructional elements, for example the bolts. A square 10 serves the purpose of holding the divided sleeve during the tightening of the threaded nut 9. Items 7 and 10 are part of the divided sleeve.

Furthermore, the metallic holding device 5 comprises a guide ring 11, which is recessed into the metallic supporting wall 1, a one-part guide sleeve 12 for the fastening element 4 and spring elements 13 arranged between the guide sleeve 12 and the guide ring 11. The spring 13 is, for example, as represented in FIG. 1, a cup spring. The resilient coupling of the ceramic structure to the metallic holding device achieves the effect that relative thermal expansions between the metallic and ceramic components or deformations of the insulating layer 2 ("settling") are absorbed by mechanical stresses, for example pulsations in the combustion space, without inadmissibly high stresses in the ceramic component being induced at the contact surfaces. Virtually constant restraining forces are ensured by means of a specific resilient excursion of the restraint (which can be set by means of the threaded nut 9 screwed on to the external thread of the sleeve 7).

It goes without saying that the invention is not restricted to the embodiment described. As a departure from the spherical form of the head and the conical form of the bearing surface, in the case of linearly expanded seats (perpendicularly with respect to the plane of the drawing), the head could also be of a circular design and the bearing surface could be of a trapezoidal design. Moreover, the proposed introduction of force may advantageously be considered for fastening all possible brittle components, provided that the introduction of force by means of a ball/cone seat is possible.

It should also be mentioned that a kinematic reversal of the principle does not achieve the object. This is because a conical head in interaction with a then toroidal bearing surface does not ensure that linear contact is maintained if there is an angular deflection of the bolt.

Obviously, numerous modifications and variations of the present invention are possible in the light of the above teachings. It is therefore to be understood that, within the scope of the appended claims, the invention may be practiced otherwise than as specifically described herein.

What is claimed is:

1. An insulated wall assembly for combustion chambers comprising: a metallic wall of a combustion chamber, a layer of insulating material applied on the metallic wall, at least one wall panel applied on the layer of insulating material, the wall panel having at least one opening, a fastening element extending through the opening and through the layer of insulating material and through the metallic wall, the wall panel having a bearing surface surrounding the at least one opening in the wall panel, the bearing surface being substantially conical, the fastening element having a head portion, the head portion having a partially spherical surface in engagement with the conical bearing surface, and holding means for resiliently urging the head portion of the fastening element against the wall panel bearing surface.

2. The wall assembly according to claim 1, wherein the fastening element is formed of a ceramic material.

3. The wall assembly according to claim 1, wherein the wall panels are formed of a ceramic material.

4. The wall assembly according to claim 1, wherein the holding means is metallic and includes a spring positioned on the side of the metallic wall that is opposite the layer of insulating material.

* * * * *